US005715949A

United States Patent [19]

Rutledge

[11] Patent Number: 5,715,949

[45] Date of Patent: Feb. 10, 1998

[54] CARPET SAMPLE DISPLAY RACK

[75] Inventor: Randy A. Rutledge, Azle, Tex.

[73] Assignee: Zimair Welded Wire Products, Inc., Fort Worth, Tex.

[21] Appl. No.: 666,955

[22] Filed: Jun. 20, 1996

[51] Int. Cl.[6] ..... A47F 7/00

[52] U.S. Cl. ..... 211/47

[58] Field of Search ..... 211/47, 96, 168, 211/169, 171, 189, 204, 45; D6/409, 410, 462

[56] References Cited

U.S. PATENT DOCUMENTS

| | | | |
|---|---|---|---|
| 610,163 | 9/1898 | Best, Sr. | 211/47 X |
| 1,180,480 | 4/1916 | Dougherty | 211/47 X |
| 2,136,168 | 11/1938 | Kern | 211/47 |
| 3,330,418 | 7/1967 | Schneider | 211/47 |
| 3,729,099 | 4/1973 | Kritske | 211/96 X |
| 4,049,125 | 9/1977 | Rochestie | 211/47 |
| 4,232,791 | 11/1980 | Howard | 211/47 |
| 4,426,007 | 1/1984 | Beleckis et al. | 211/47 X |
| 5,452,809 | 9/1995 | Capel | 211/47 |

*Primary Examiner*—Leslie A. Braun
*Assistant Examiner*—Sarah L. Purol
*Attorney, Agent, or Firm*—James E. Bradley

[57] ABSTRACT

A sample display rack is designed for displaying samples of flat materials like carpet. The sample display rack has a stand with an upper and a lower horizontal cross member connected to vertical support rods with each rod rotating about its vertical axis. A swing arm is connected to each rod and has a horizontal portion connected to the upper portion of the rod and a bracing portion angling down to the lower portion of the rod. A mounting assembly is used to connect the display sample to the swing arms. The mounting assembly has a mounting sleeve with an upper wall and two perpendicular side walls that fit around the cross section of the swing arm. The free end of each side wall has an abutting lip extending inward for preventing excessive flexing of the mounting sleeve. A display clamp extends outward from each mounting sleeve side wall. Each display clamp has an upper wall joined to the mounting sleeve and a side wall depending downward from the upper wall. The free end of each display clamp side wall has a clamping lip extending inward for releasably gripping the display sample.

13 Claims, 2 Drawing Sheets

CARPET SAMPLE DISPLAY RACK

BACKGROUND OF THE INVENTION

1. Field of the Invention

This invention relates to a display rack for displaying samples of flat materials, particularly carpet samples.

2. Description of the Prior Art

Stores use display racks to organize samples, to hold them in place for customer viewing, and to store the samples until a salesperson temporarily removes them to demonstrate them for customers or to replace them with other samples. These uses require the display rack to allow easy access and separation of the samples, to orient the samples in an attractive manner, and to allow easy removal and replacement of several shapes and sizes of samples. Accomplishing all of these goals becomes especially challenging when the sample materials displayed are flexible and flat like patches of carpet. As a result, there is a need for display racks that accomplish all three goals.

In the past, stores have relied on display racks that only provide some of the desired attributes. For example, the most simple rack is a box with either horizontal or vertical slots that arranges the samples in a waterfall method. This type adequately organizes the samples, but viewing the samples is difficult without actually removing them and this method fails to accommodate different sample sizes. The samples in these racks actually cover significant portions of each other, blocking the customer's view of the sample. Furthermore, removing and replacing the carpet samples is difficult because of their flexibility, especially with horizontal slots where several samples are often stacked on one another. Another type of display rack for samples of flat materials is a U-shaped frame with the samples pivotally connected at the bottom of the frame. This rack allows the samples to be leaned against opposite sides of the frame such that the desired sample can be clearly viewed apart from the others. However, this rack design also has shortcomings because the samples of different sizes may block the view of others and the samples might buckle inside the frame when the user rotates them. In addition, the samples may be difficult to remove and replace in the rack depending on what sort of fastener is used to connect the bottom of the samples to the frame. A third display rack design includes a flat board with a semi-circular ring extending vertically from its center. The samples are then fastened to the ring with a fastener that can travel from one side of the ring to the other. In this way, the samples are stacked on one side and the top of the stack can be flipped to the other side of the ring until the desired sample is uncovered. Again, the samples can be viewed easily, but use of the rack may be difficult because of the flexibility of the samples and samples of different sizes may add to this difficulty.

As can be seen from these examples, there is a need in the art for a sample display rack for flat materials that combines all of the desired functions by allowing for effective organization, easy viewing, and easy removal and replacement of many different sizes of samples.

SUMMARY OF THE INVENTION

In this invention, the sample display rack includes a stand with swing arms that rotate around vertical axes and mounting assemblies that secure the samples and connect them to the swing arms. The stand has an upper and a lower horizontal cross member that position vertical support rods while allowing each to rotate about its axis. A V-shaped swing arm with a horizontal portion extending perpendicularly from the upper portion of the rod and a bracing portion angling down to the lower portion of the rod is then connected to each vertical rod. The mounting assembly has a mounting sleeve with an upper wall and two perpendicular side walls that fit around the cross section of the swing arm. The free end of each side wall has an abutting lip extending inward to prevent excessive flexing of the mounting sleeve. The mounting sleeve allows removal and replacement of the mounting assembly on the swing arm. Extending from each side of the mounting sleeve is a display clamp to releasably grip the display samples. Each display clamp has an upper wall joined to the outer surface of the side wall of the mounting clamp and a side wall depending downward from this upper wall. The free end of the side wall has a clamping lip extending inward for gripping the display sample.

DETAILED DESCRIPTION OF THE INVENTION

Although the invention has been described with reference to a specific embodiment or embodiments, this description is not meant to be construed in a limiting sense. Various modifications of the disclosed embodiment as well as alternative embodiments of the invention will become apparent to persons skilled in the art upon reference to the description of the invention.

Figure 1:
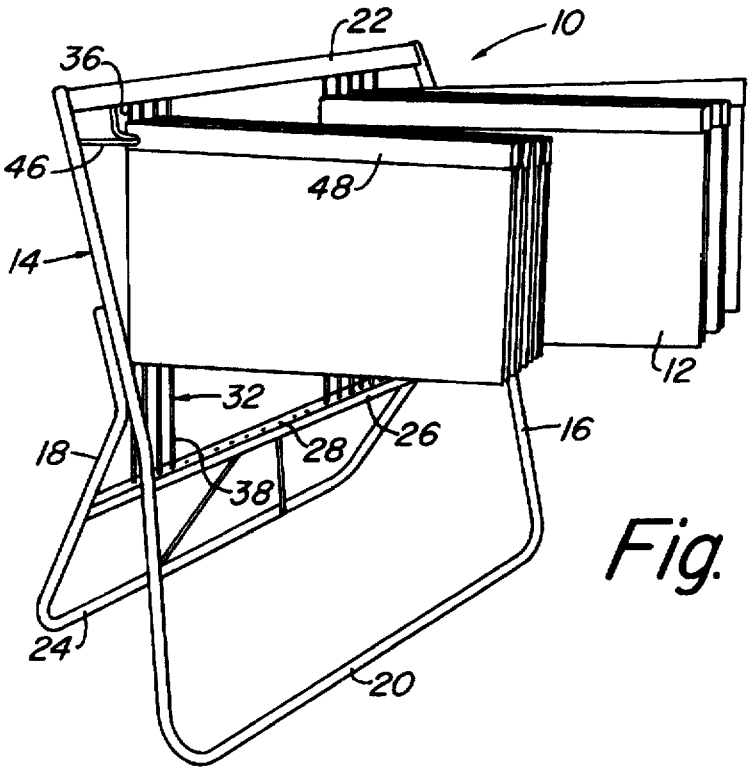
FIG. 1 is a perspective view of a carpet sample display rack of the invention having carpet samples mounted thereto by means of mounting assemblies constructed in accordance with the invention.

Referring to FIG. 1, a carpet sample display rack 10 is shown for holding and displaying carpet samples 12. The display rack 10 is formed from a tubular steel or aluminum stand or frame 14 having a front section 16 and a rear section 18 which are joined together. The front section 16 of the frame 14 has a generally U-shaped configuration with the lower portion corresponding to the curved or bent portion of the U shape. As can be seen, the lower portion of the front section 16 serves as a supporting leg 20 which rests upon the ground or other support surface. The upper portion of the front section 16 is set at an angle from the lower portion, as can be seen in FIG. 1. An upper cross member 22 extends across and is mounted to the ends of the arms of the U-shaped front section 16 by means of welds or fasteners. The upper cross member 22 may have a sign (not shown) mounted or secured thereto for providing printed information or advertising with respect to the carpet samples 12 that are displayed.

The rear section 18 also has a general U-shaped configuration. The upper portion of the rear section 18 is joined to the upper portion of the front section 16, with each arm of the U-shaped rear section 18 being joined to a corresponding arm of the U-shaped front section 16. The lower portion of the U-shaped rear section also serves as a supporting leg 24 which rests on the ground or other support surface. As can be seen in FIG. 1, the front and rear supporting legs 20, 24 are spaced apart a sufficient distance to serve as a base of the frame 14 so that the frame 14 is self-supporting.

A lower cross member 26 extends across and is mounted to the arms of the U-shaped rear section 18 by means of welds or fasteners. The lower cross member 26 is aligned directly below the upper cross member 22 of the front section 16. Both the upper and lower cross members 22, 26 have evenly spaced apertures 28 formed therein, with the apertures of the upper cross member 22 aligning with those of the lower cross member 26.

Figure 2:
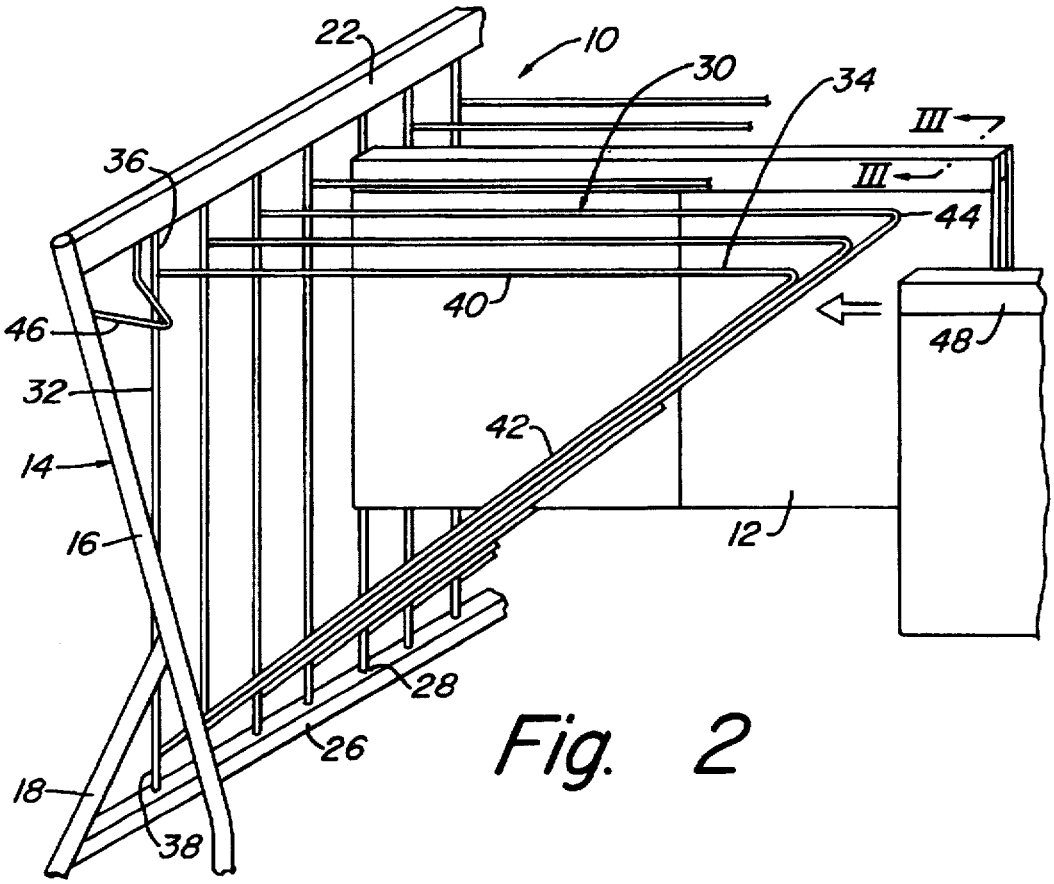
FIG. 2 is a perspective view of the display rack of FIG. 1, showing some of the carpet samples pulled away from the display rack.

As shown in FIG. 2, a plurality of steel wire carpet hangers 30 are provided with the frame 14. Each hanger 30 has a generally triangular configuration and consists of a vertical or upright rod 32, with a generally V-shaped swing arm 34 projecting therefrom, for mounting the carpet samples 12. The upper end 36 of each rod 32 is received within one of the apertures 28 of the upper cross member 22. Similarly, the lower end 38 of each rod 32 is received within a corresponding aperture 28 of the lower cross member 26 so that the rod 32 can be rotated about its longitudinal axis within the apertures 28.

The V-shaped swing arm 34 is formed from a single wire member bent at an acute angle. The free ends of the swing arm 34 are joined, by means of a weld or otherwise, to the rod 32. The swing arm 34 has a generally straight horizontal upper portion 40 and a sloping lower bracing portion 42, with the bend or crooked portion 44 of the wire 34 being located opposite the upright rod 32. The bracing portion 42 lends support to the horizontal portion 40 when the carpet samples 12 are mounted thereon.

A stop 46 mounted on either side of the upper end of the frame 14 may be provided to engage the swing arms 34 to prevent their full rotation.

Figure 3:
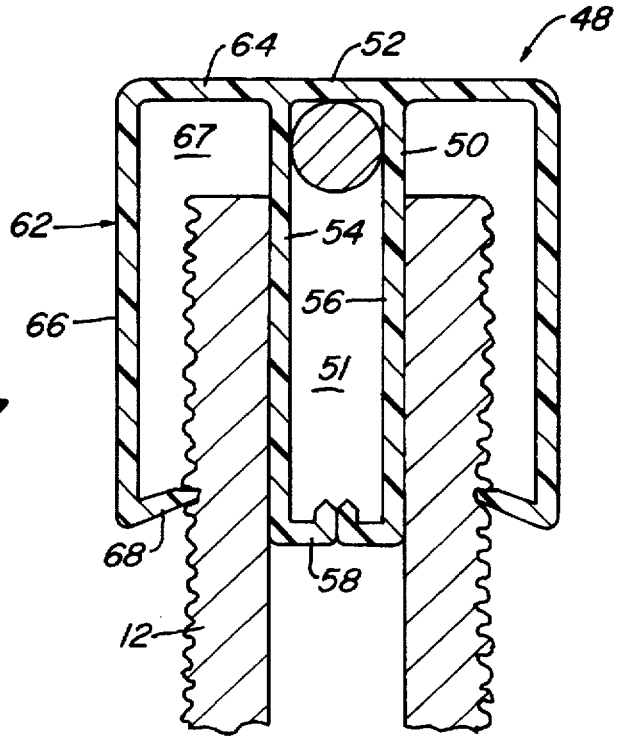
FIG. 3 is a cross section of a mounting assembly of FIG. 2, taken along the lines III—III.

The carpet samples 12 are mounted to the hangers 30 by means of mounting assemblies 48. FIG. 3 shows a cross-sectional view of the mounting assembly 48. The mounting assembly 48 is formed from an extruded, rigid plastic material and has essentially the same cross section along its entire length. Each mounting assembly 48 consists of a plastic mounting sleeve 50 having a central opening 51 of a generally rectangular cross section.

The mounting sleeve 50 has a flat upper wall 52. Extending downward from the upper wall 52 are opposite, parallel side walls 54, 56 which are spaced arm a distance at least as great as the width of the horizontal portion 40 of the swing arm 34 to accommodate it during mounting. Each of the side walls 54, 56 terminates in an inwardly projecting abutting lips 58 having a length approximately half the width of the sleeve opening 51. The ends of the abutting lips 58 abut one another to thus form a lower wall of the sleeve 50.

Integrally formed with the sleeve 50 are display clamps 62 for holding the carpet samples 12. The display clamps 62 each have an upper portion 64 which projects outward a short distance from the upper end of either side wall 54, 56 of the sleeve 50. In the embodiment shown, the upper portion 64 of each clamp 62 is flush with the flat upper wall 52 of the sleeve 50. Extending downward from the outer end of the upper portion 64 is a flat side wall 66 of the display clamp 62. The display clamp side wall 66 is substantially parallel with the side walls 54, 56 of the sleeve 50. Each display clamp side wall 66 is spaced apart a distance from the exterior of the side walls 54, 56 of the sleeve 50 to define a recess 67.

An inwardly projecting clamping lip or hook 68 is provided on the free end of the display clamp side wall 66. The inward projecting clamping lip 68 engages the carpet samples 12 when they are inserted into the recess 67 so that the carpet samples 12 are held securely against the side walls 54, 56 of the sleeve 50.

Mounting of the carpet samples 12 to the display rack 10 is carried out as follows. With an empty mounting assembly 48, a carpet sample 12 is fitted into each of the recesses 67 defined by the mounting sleeve side walls 54, 56 and the display clamps 62. The lip 68 of each clamp 62 should project far enough inward so that when a carpet sample 12 is inserted into the recess 67, the free end of the side wall 66 of the clamp 62 is forced outward slightly, so that an inward biasing force is created by the resiliency of the plastic material. Each clamp 67 thus exerts pressure against the carpet samples 12 so that the carpet samples are securely held in place within the recess 67.

As can be seen in FIG. 1, the length of each mounting assembly 48 may be sufficient enough to accommodate more than one carpet sample, with the carpet samples 12 being displayed in a side-by-side fashion.

With the carpet samples 12 secured to the mounting assembly 48 as described, each mounting assembly 48 is mounted to one of the swing arms 34. This is accomplished by inserting the crooked portion 44 of the swing arm 34 into the opening 51 of the sleeve 50. Initially, it may be necessary to force the abutting lips 58 apart to accommodate the lower bracing portion 42 of the swing arm 34 as the sleeve 50 is passed over the horizontal portion 40 of the swing arm 34. The mounting assembly 48 is then pushed to the rear of the swing arm 34 until it is fully seated over the horizontal portion 40.

The above procedure is repeated until the desired number of carpet samples 12 are mounted onto the display rack 10. When the carpet samples 12 are mounted as described, the swing arms 34 can be pivoted from side to side about the upright rods 34 so that the carpet samples can be easily accessed and viewed.

Figure 4:
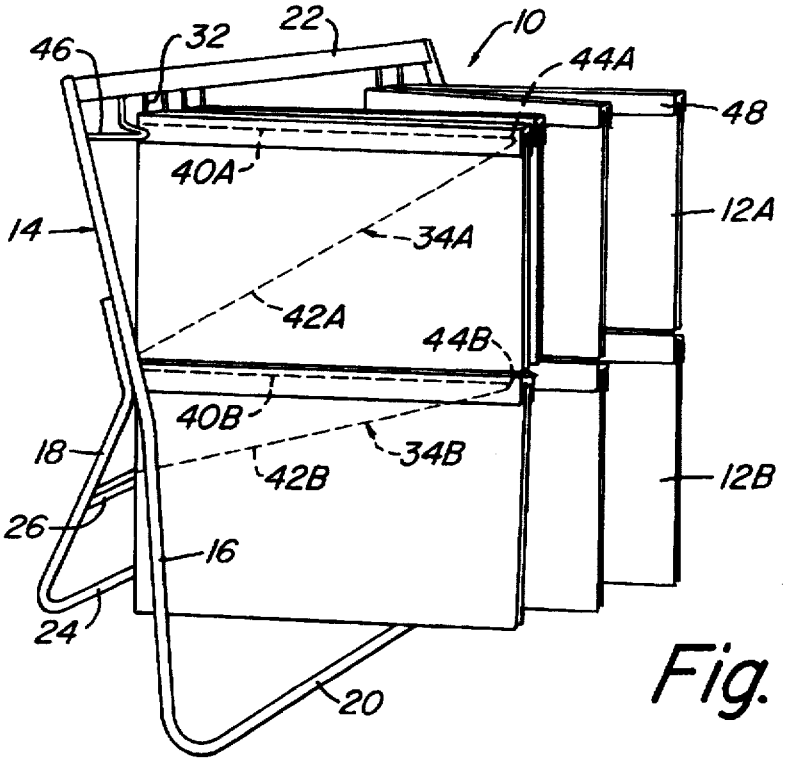
FIG. 4 is a perspective view of a carpet sample display rack having two tiers of carpet samples and constructed in accordance with the invention.

FIG. 4 shows a display rack constructed in generally the same manner as that of FIGS. 1–3, but having two tiers of carpet samples 12A, 12B. This is accomplished by having two swing arms 34A, 34B joined to each upright rod 34 in a vertical stacked relation. The swing arms 34A, 34B should be spaced apart far enough so that the carpet samples 12A do not significantly interfere with the samples 12B located beneath.

While the invention has been shown in only some of its forms, it should be apparent to those skilled in the art that it is not so limited but is susceptible to various changes without departing from the scope of the invention.

I claim:

1. A display rack for displaying samples of a flat material, comprising:

a stand having an upper cross member above a lower cross member;

a plurality of rods each having an axis, each being connected between the upper and lower cross members, each being rotatable about its axis;

a plurality of swing arms, each connected to one of the rods, each swing arm having a horizontal portion and extending laterally from the corresponding rod;

a mounting sleeve having an upper wall and two side walls perpendicular to the upper wall, the two side walls being spaced laterally apart and receiving the horizontal portion of the swing arm, the two side walls having free lower ends, each side wall having an abutting lip extending from its lower end inward toward the other side wall approximately half the distance to the other side wall, the lips of each of the side walls abutting each other; and a pair of display clamps, each of the display clamps having an upper portion which integrally joins an outer surface of one of the mounting sleeve side walls, each having a clamp side wall depending downward from the upper portion of the clamp, each of the clamp side walls having a clamping lip extending from its free end inward toward the mounting sleeve side wall, each of the clamp side walls being resilient for gripping the sample between the lip and the mounting sleeve side wall.

2. The display rack of claim 1 wherein the stand has supporting legs for resting on the ground and a pair of upright members, the upper cross member being mounted between the upright members, the lower cross member being mounted between two of the supporting legs.

3. The display rack of claim 1 wherein each of the display clamp lips extends at an angle of less than 90 degrees relative to the respective mounting sleeve side Wall.

4. The display rack of claim 1 wherein at least two swing arms are connected to each of the rods, one above the other.

5. The display rack of claim 1 further comprising means for limiting the rotation of the swing arms.

6. A display rack for displaying samples of a flat material, comprising:

a stand having an upper cross member above a lower cross member, the upper cross member having a lower edge with apertures, and the lower cross member having an upper edge with apertures which correspond with the apertures in the upper cross member;

a plurality of rods, each having an axis, each being fitted into the corresponding apertures of the upper and lower cross members, and each being rotatable about its axis;

a plurality of swing arms, each connected to one of the rods, each swing arm having an upper portion extending perpendicular to the corresponding rod and a diagonally extending bracing portion connected to the corresponding rod and supporting the upper portion;

a mounting sleeve having an upper wall and two side walls perpendicular to the upper wall, the two side walls being spaced laterally apart and receiving the upper portion of the swing arm, the two side walls having free lower ends, each side wall having an abutting lip extending from its lower end inward toward the other side wall approximately half the distance to the other side wall, the lips of each of the side walls abutting each other, the mounting sleeve defining a cavity between the lips and the upper wall which is adapted to receive part of the bracing portion; and a pair of display clamps, each having an upper portion which integrally joins an outer surface of one of the mounting sleeve side walls, a clamp side wall depending downward from the upper portion of the clamp, the display clamp side wall of each of the display clamps having a clamping lip extending from its free end inward toward the mounting sleeve side wall at an angle of less than 90 degrees relative to the respective clamp side wall, each of the display clamp side walls being resilient for gripping a sample between the lip and the mounting sleeve side wall.

7. The display rack of claim 6 wherein the stand has supporting legs for resting on the ground and a pair of upright members, the upper cross member being mounted between the upright members, the lower cross member being mounted between two of the supporting legs.

8. The display rack of claim 6 wherein each upper portion of each swing arm has sufficient length to carry at least two of the mounting sleeves.

9. The display rack of claim 6 wherein at least two of the swing arms are connected to each one of the rods, one above the other.

10. The display rack of claim 6 further comprising stop means on the display rack for limiting the rotation of the swing arms.

11. A display rack for displaying samples of a flat material, comprising:

a stand having supporting legs for resting on the ground and a pair of upright members;

the stand having an upper cross member mounted between the upright members directly above a lower cross member mounted between two of the supporting legs, the upper cross member having a lower edge with apertures, and the lower cross member having an upper edge with corresponding apertures;

a plurality of cylindrical rods, each having an axis, each being fitted vertically into the corresponding apertures of the upper and lower cross members, each being rotatable about its axis;

a plurality of swing arms, each connected to one of the rods, each swing arm having a horizontal portion extending perpendicular to the corresponding rod and a bracing portion connected to the corresponding rod and supporting the horizontal portion;

a mounting sleeve having an upper wall and two side walls perpendicular to the upper wall, the two side walls being spaced laterally apart and receiving the horizontal portion of the swing arm, the two side walls having free lower ends, each side wall having an abutting lip extending from its lower end inward toward the other side wall approximately half the distance to the other side wall, the lips of each of the side walls abutting each other;

a pair of display clamps, each having an upper portion which joins an outer surface of one of the mounting sleeve side walls, each having a clamp side wall depending downward from the upper portion of the clamp, each of the display clamp side walls having a clamping lip extending from its free end inward toward the mounting sleeve side wall at an angle with the display clamp side wall of less than ninety degrees, each of the display clamp side walls being resilient for gripping the sample between the lip and the mounting sleeve side wall; and wherein the mounting sleeve and display clamps are integrally formed with each other.

12. The display rack of claim 11 wherein each horizontal portion of each swing arm has sufficient length to carry at least two of the mounting sleeves.

13. The display rack of claim 11 wherein at least two swing arms are connected to each of the rods, one above the other.

* * * * *